US005544554A

United States Patent [19]

Brightly

[11] Patent Number: 5,544,554

[45] Date of Patent: Aug. 13, 1996

[54] ERGONOMIC TORQUE WRENCH MOUNTING

[75] Inventor: Todd J. Brightly, Hudson, N.Y.

[73] Assignee: International Business Machines Corporation, Armonk, N.Y.

[21] Appl. No.: 326,577

[22] Filed: Oct. 20, 1994

[51] Int. Cl.[6] ..... B25B 29/00

[52] U.S. Cl. ..... 81/57.4; 29/240

[58] Field of Search ..... 81/57.4; 29/240; 173/170; 227/110, 111

[56] References Cited

U.S. PATENT DOCUMENTS

| | | | |
|---|---|---|---|
| 3,333,613 | 8/1967 | Bosse | 81/57.4 |
| 3,694,888 | 10/1972 | Bosse | 29/240 |
| 3,910,325 | 10/1975 | Dixon | 144/32 |
| 4,483,219 | 11/1984 | Sticht et al. | 81/57.14 |
| 4,782,726 | 11/1988 | Ryder et al. | 81/57.4 |
| 5,109,736 | 5/1992 | Dixon | 81/57.4 |

*Primary Examiner*—James G. Smith
*Attorney, Agent, or Firm*—H. Daniel Schnurmann

[57] ABSTRACT

An automatic assembly apparatus for repetitively driving fasteners into a work piece without having an operator's arms and wrists absorb torques generated during the fastening operation. A pneumatic torque wrench is mounted on a torque arm attached to a rigid surface. The torque wrench is free to move around any axis required for the application. All axis lock when the wrench is engaged, allowing the operator to remove his/her hands when the wrench is in operation. A combination of an air cylinder coupled to a compressive spring drives the wrench downward until the wrench is positioned at the fastener for torquing. Incidence of carpal tunnel syndrome or other similar repetitive stress injuries (RSI) are eliminated since the operator is allowed to remove his/her hands while the wrench is in operation. The mass of the wrench absorbs all the torque generated by the fastening operation.

14 Claims, 3 Drawing Sheets

ERGONOMIC TORQUE WRENCH MOUNTING

FIELD OF THE INVENTION

The present invention relates to an automatic assembly apparatus and, more particularly, to an ergonomic assembly apparatus of the type having a fastener driver for assembling fasteners into a work piece.

BACKGROUND OF THE INVENTION

Automatic assembly apparatus for fastening fasteners, such as screws, bolts, nuts, and the like are known in the art. Generally, prior art automatic assembly machines include a drive head for driving the fastener and a manipulator for positioning the drive head with respect to the workpiece. Additionally, the drive head may be equipped with an automatic feed for providing the fastener to the drive head.

Primarily, these prior art automatic assembly machines represent a trade-off between positioning flexibility and operator comfort. So, where one prior art machine might be extremely flexible, allowing the machine operator to position the drive head as he pleases, repeated flexing force is transmitted to the operator from the drive head as the fastener is torqued down. This repeated flexing force can lead, eventually, to Repetitive Stress Injuries (RSI) such as carpal tunnel syndrome. RSI's occur when a particular portion of the body is repeatedly subjected to the same or similar type of stressful movement or impact, which although normally not injurious, becomes so with repetition.

Prior art efforts to reduce RSI associated with automatic assembly machines focused on reducing carpal tunnel syndrome by foregoing positioning flexibility. By way of example, in U.S. Pat. No. 5,109,736, entitled "Automatic Assembly Machine with Steering/Up-Down Control Handle" to Dixon, incorporated herein by reference, Dixon teaches an automatic screwdriver mounted on a cantilevered support. The support allows the screwdriver to be positioned horizontally on the workpiece by the operator. The screwdriver is activated when the operator forces it downward toward the workpiece. Dixon's automatic assembly machine reduces carpal tunnel from torque because the screwdriver is fixedly mounted to the vertical drive of the support such that it cannot rotate. However, the operator must still apply downward force to Dixon's machine each time a screw is screwed into a workpiece. This repetitive downward force stresses areas of the body such that RSI (even carpal tunnel) can still occur. Further, since Dixon's drive head (screwdriver) is fixedly mounted to the vertical support drive, positioning the driver over the fastener may be difficult, e.g., positioning a drive socket over a nut.

OBJECTS OF THE INVENTION

It is an object of the present invention to reduce the incidence of repetitive stress injuries in the workplace.

It is another object of the present invention to reduce the incidence of repetitive stress injuries to operators of automatic assembly machinery.

It is yet another object of the present invention to maintain tool positional flexibility while reducing the incidence of repetitive stress injuries to operators of automatic assembly machinery.

It is a more particular object of the present invention to have an operator assemble threaded fasteners into a work piece repetitively without the operator's arms and wrists having to absorb torques and counter torques generated by the fastening operation.

It is a further object of the present invention to allow the operator to remove his hands once the assembly apparatus is engaged to initiate the assembly process.

It is a still a further object of the present invention to allow the operator to minimize the incidence of carpal tunnel syndrome or other similar injuries by eliminating the need for manually offsetting torque generated by the assembly apparatus.

SUMMARY OF THE INVENTION

In accordance with present invention, it is provided an automatic assembly apparatus comprising: mounting means pivotally anchored at one end to a fixed point of reference for securing and rotating the assembly apparatus; automatic fastener driver coupled to a second end of the mounting means and supported by the mounting means, the driver including bit driving means for rotatably driving a bit; automatic vertical positioning means for vertically positioning the driver on a work piece and for automatically vertically driving the bit when the bit is rotatably driven, the automatic vertical positioning means include counterbalance means to selectively overcome the weight of the assembly apparatus; and gripper means for selectively preventing the fastener driver from rotating.

BRIEF DESCRIPTION OF THE DRAWINGS

Details of the embodiment of the invention will be explained in the following description with reference to the attached drawings in which.

TECHNICAL DESCRIPTION OF THE PREFERRED EMBODIMENT

Figure 1:
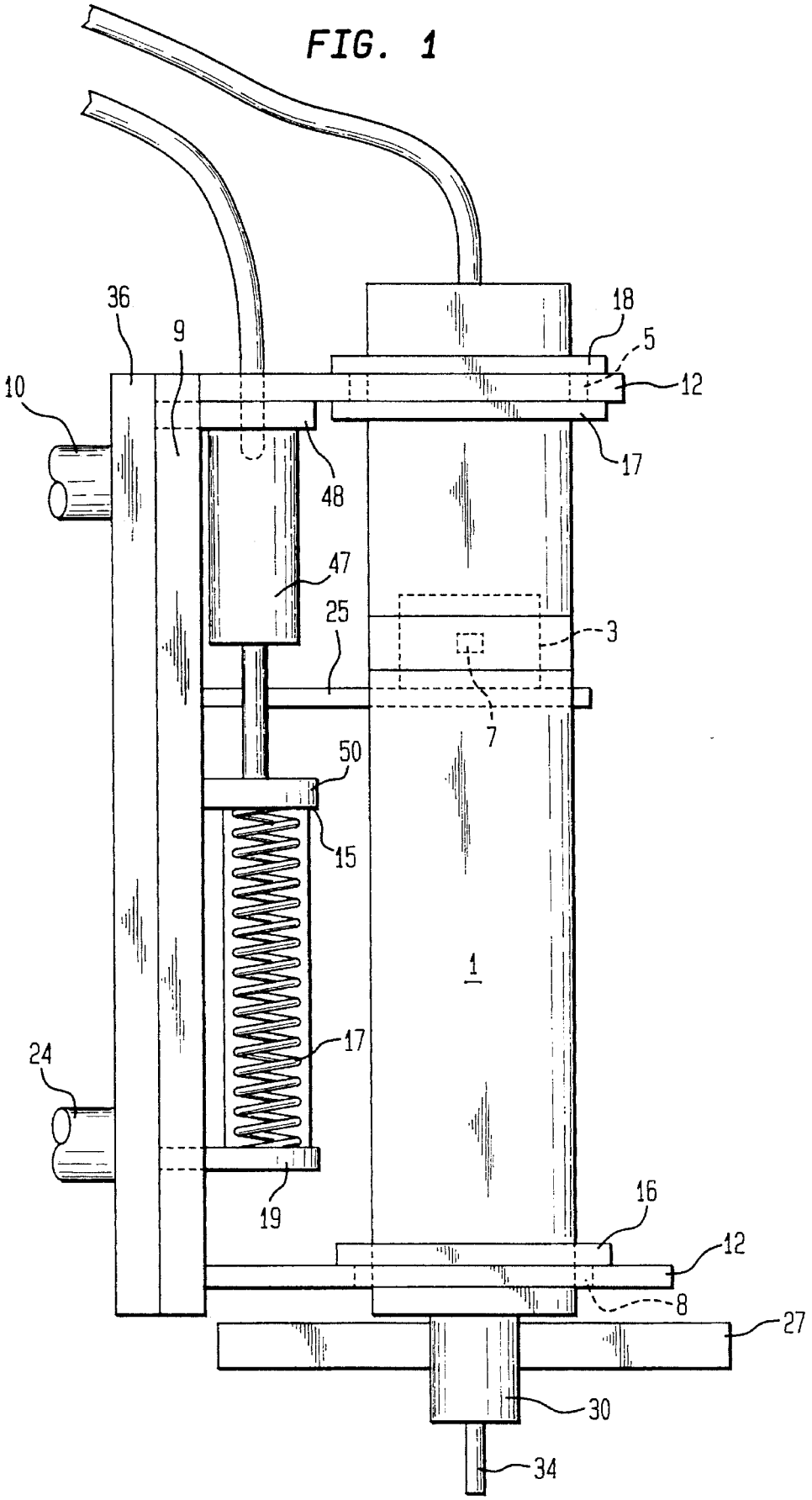
FIG. 1 is a side view of the apparatus according to the preferred embodiment of the present invention.

FIG. 1 shows a side view of a preferred embodiment of the automatic assembly apparatus 100 of the present invention.

A pivotal torque arm 51 securely anchored at one end to a rigid surface, such as a bench top (15 in FIG. 4), frame and the like, is secured to the assembly power block screwdriver head (or wrench) 1 at an opposing end via an upper hinge joint 10 and lower hinge joint 24, which are mounted to an inner slide 9. Although hinge joints 10 and 24 allow for a movement in the horizontal direction, they do not permit the assembly to rotate in the vertical direction, since such a movement would interfere with the pressure to be exerted by the operator. Bearings 5 inside the mounting 12 permit the head to freely swivel. Collars 17 and 18 hold the wrench 1 in place, keep it from being accidentally dismounted, and allow it to swivel. A similar arrangement also exists for the lower support (or mounting) 12 using collar 16.

The attachment to the frame is such that it allows rotation of the apparatus in a 360° motion when the apparatus is in a free state. Likewise, the frame pivots in the X,Y direction around a shaft attached to the torque arm 51 and secured to the frame by a screw. The combination of the rotational motion and translational motion provides the apparatus with the ability of adapting to any position with respect to the work piece, and allows the operator to position the screwdriver or wrench at a desired position on the work piece (not shown). The apparatus further allows the operator to fasten a screw without exerting undue effort over long periods of time that may lead to extreme fatigue or discomfort. The apparatus also avoids subjecting the operator's hand or wrist to stresses that may lead to carpal tunnel syndrome. The moving slide 9 allows the wrench to move in the vertical direction (i.e., in the Z-direction). Practitioners of the art will fully appreciate that prior to driving the fastener into the work piece, the apparatus 100 needs to be locked in position, which is accomplished by a set of grippers (FIG. 2), and which inhibit the apparatus from rotating.

Figure 2:
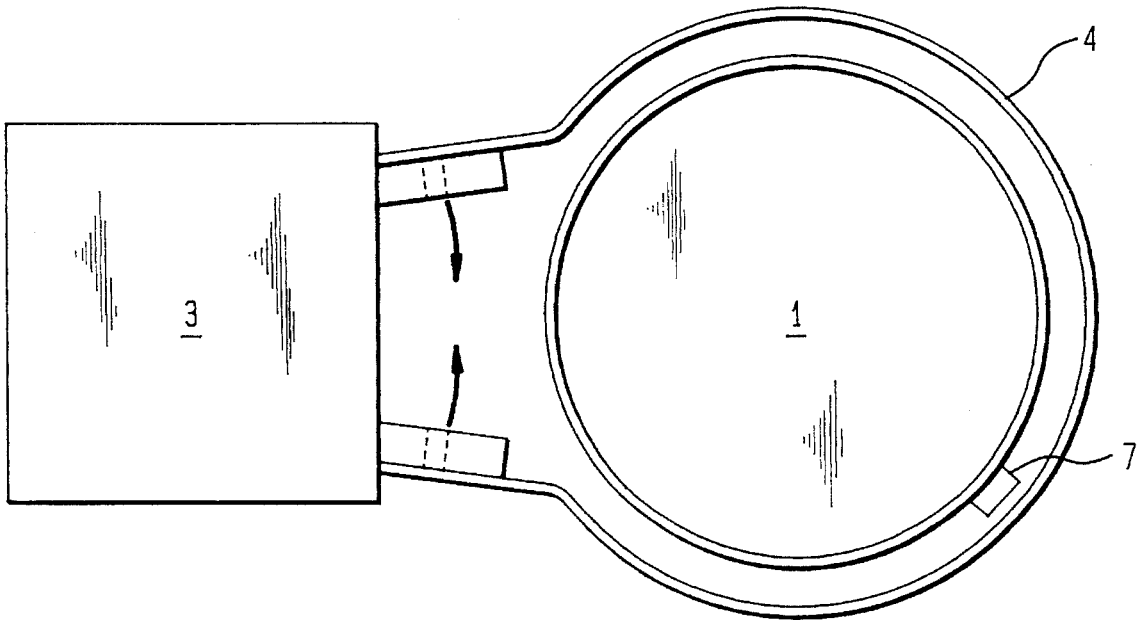
FIG. 2 is a top view of the gripper in accordance with the preferred embodiment of the present invention.

Referring now to FIG. 2 showing a top down view of the gripper, the wrench is surrounded by a circular strap 4 or band clutch, wherein the band extends at one protruding end to terminate in between two arms of a mechanical or air jaw positioned in a gripper mount 3 which, in turn, is secured to the inner slide 9 via support 25 (FIG. 1). The wrench is additionally provided with an ON/OFF switch 7, and is designed such that when the gripper is exercised, its two arms pivotally close on each other, tightening in the process the band clutch 4 surrounding the wrench and depressing the ON/OFF switch 7.

Figure 3:
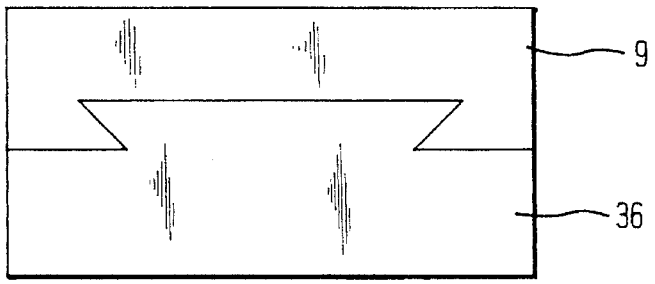
FIG. 3 is a top view of the slide mount.

Referring back to FIG. 1, in accordance with a significant feature of the present invention, an air cylinder 47 is secured to the slide via a mount 48. An outer slide 36 is rigidly attached (e.g., screwed, bolted or welded) to the torque arm 51. The inner slide 9 is dovetailed into the outer slide 36 such that one end of the air cylinder is mounted to the outer slide 36, whereas its opposing end is attached to the inner slide 9 (see FIG. 3). This allows the air cylinder 47 to brace against the outer slide and move the inner slide in an upward and downward motion by pressing against a bracket 50 which is attached to the inner slide 9. Brackets 48 and 19, as shown, are rigidly attached to slide 36. Such an attachment is made possible by having a vertical ridge extending longitudinally through slide 9 to permit a vertical movement of slide 9 with respect to slide 36. Bracket 50, on the other hand, is permanently attached to slide 9. Spring 17, in a compressive mode, is likewise mounted in the same fashion between mounts 15 and 19. The spring 17 forces the wrench upwards.

Pressure in the air cylinder 47 is offset by the balancing action of spring 17, (i.e., the air cylinder 47 opposes the force generated by spring 17). Pressure in the air cylinder is adjusted to slightly overcome the compressive force exerted on the spring 17 so that the operator can easily lower the wrench at the appropriate location over the workpiece by overcoming the compressing force of the spring.

For certain applications, the wrench or screwdriver is to insert a fastener into a work piece that necessitates the apparatus to be in a position other than vertical. In such instances, the inner and outer slides can be adjusted to any angle that permits driving a fastener automatically, regardless of the relative position between the work piece and the apparatus. The ability of the apparatus to rotate freely around any axis (when in a free state) is of particular importance when the work piece is placed in an awkward position with respect to the operator, e.g., above the head, which requires extending the arms upwardly to a highly uncomfortable position. By rotating the apparatus or by displacing it a considerable distance, the operator may achieve the same result without subjecting him/herself to a strain which can be injurious to the back. By way of example, if the work piece is placed above the operator's head, the apparatus can be mounted on a post secured to the floor and/or to the ceiling, allowing the apparatus to slide up and down the post as required.

In high torque applications, wherein an operator maintains hands and arms in an unnatural position or where prolonged exertion is required, the apparatus is designed such that its various parts can absorb the undesired torque moment that is generated in the course of inserting a fastener into the work piece. As such, when the apparatus is in operation, the wrench, torque arm and mounting surfaces are locked in position to make the apparatus a single, integral entity. Thus, when the fastener has been completely driven into the work piece and it is no longer possible to push it any further, a counter torque of significant magnitude is generated which is routinely absorbed by the wrist of the operator. In the present invention, this counter torque is now absorbed by the large mass that comprises the apparatus.

Control of the wrench by the operator is further maintained by a handle 27 that guides the operator to appropriately position the bit 34 directly on top of the work piece (not shown). The handle 27 is preferably positioned horizontally to help the operator avoid twisting his/her wrist, a primary cause of RSI.

OPERATION OF THE ASSEMBLY APPARATUS

Figure 4:
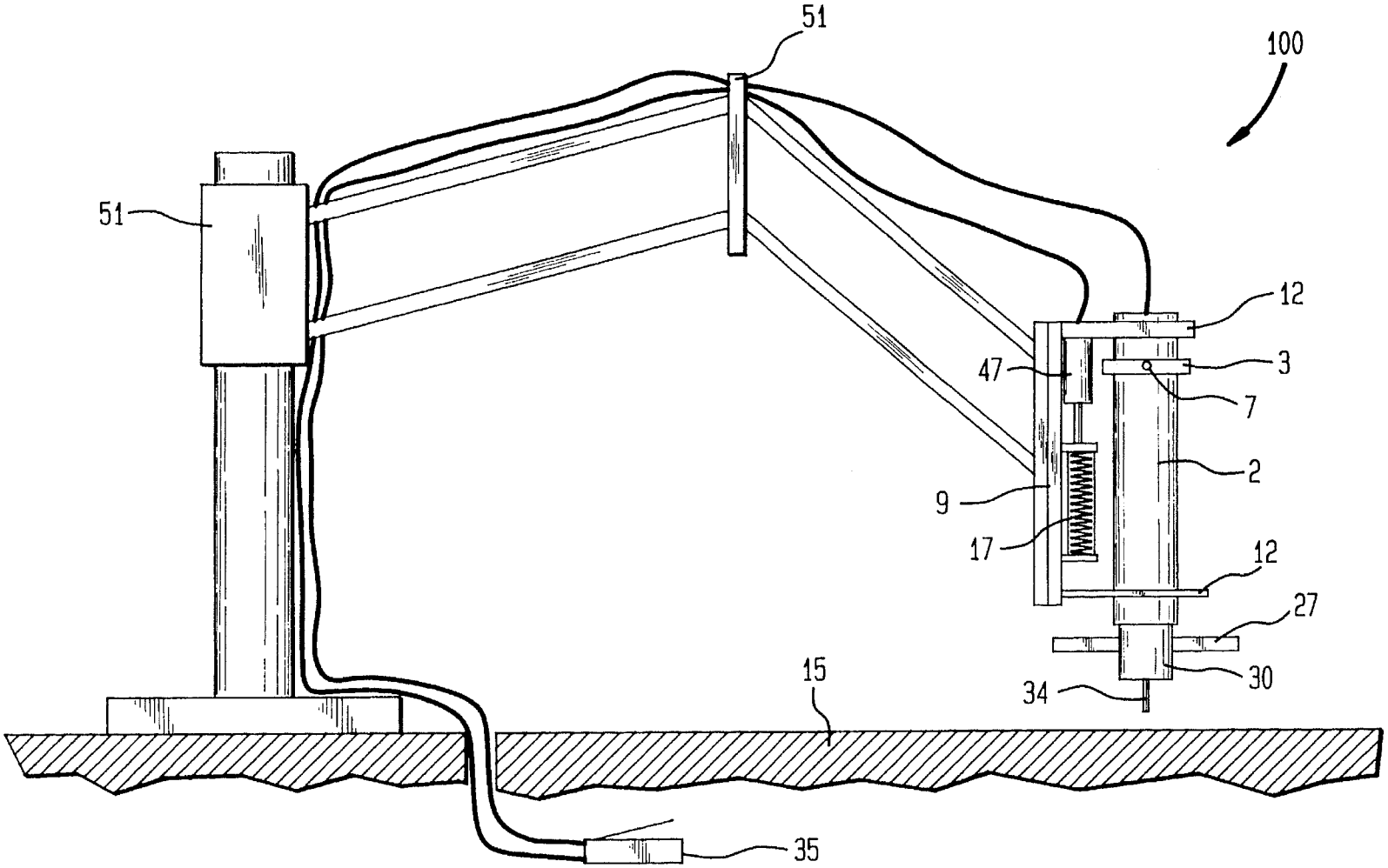
FIG. 4 shows a side view of the assembly apparatus anchored to a rigid surface in accordance with the present invention.

The operation of the wrench (or screwdriver) of the preferred embodiment of the present invention is as follows. The operator places a bit 34 into the chuck 30 of the torque wrench or screwdriver and secures it in a fixed position by tightening the chuck. Practitioners of the art will readily appreciate that other equivalent and effective means, such as inserting the bit 34 in a sleeve, are known to exist. Rotation of the bit by a pneumatic bit driver, or more particularly, by a rotary air or DC motor is similarly performed in accordance to known techniques. The assembly apparatus is then positioned on the work piece. At this time, the wrench and torque arm 51 are free to move in any direction. The operator grasps the handle 27 and moves the apparatus downward, rotates the bit 34 as required for proper alignment and inserts it in the target fastener (not shown). During this time, the operator presses down the apparatus 100 to overcome the spring loaded slide. Once the apparatus is properly positioned, the operator presses and holds down a foot pedal 35 (FIG. 4). This action activates air cylinder 47 which overcomes the compression spring 17, thereby forcing the slide assembly downward. The gripper 3 is energized, the band clutch 4 tightens as a noose around the wrench 1 depressing the ON/OFF switch 7 (or button). The switch, in a depressed mode, inhibits the wrench from rotating by a clamping action of the air jaw. With the wrench in a locked position, the fastener, torqued by bit 34, is driven into the work piece while maintaining the spring loaded chuck compressed. The assembly positioned as such is driven downwards at the slide by air cylinder 47. The operator is free to let the apparatus go, since the mounting system has taken over. Once the cycle is complete, the operator releases the foot pedal, the ON/OFF switch 7 (or button) is deactivated by the loosening action of the gripper arms and, correspondingly, the band clutch 4 becomes loose, returning the apparatus 100 to a free state (i.e., free to rotate) and ready for the next fastener.

Comfort and convenience are further enhanced by virtue of the fact that any and all torques are fully absorbed by the mounting arm, thereby freeing the operator from having to exert undue force to drive the screw into the work piece.

Whereas the present invention has been particularly shown and described with reference to a preferred embodiment thereof, it will be understood by those skilled in the art that the foregoing and other changes in form and details may be made therein without departing from the spirit and scope of the invention.

What is claimed is:

1. An automatic assembly apparatus comprising:

mounting means pivotally anchored at one end to a fixed point of reference for securing and rotating the assembly apparatus;

automatic fastener driver coupled to a second end of the mounting means and supported by the mounting means, the driver including bit driving means for rotatably driving a bit;

automatic vertical positioning means for vertically positioning the driver on a work piece and for automatically vertically driving the bit when the bit is rotatably driven, the automatic vertical positioning means include counterbalance means to selectively overcome the weight of the assembly apparatus; and gripper means for selectively preventing the fastener driver from rotating.

2. The automatic assembly apparatus as recited in claim 1, said fastener driver further including an air motor for rotatably driving said bit.

3. The automatic assembly apparatus as recited in claim 1, including a sleeve for holding a bit, said sleeve positioned at an end of said automatic vertical positioning means.

4. The automatic assembly apparatus as recited in claim 1, wherein said automatic vertical positioning means is an air cylinder.

5. The automatic assembly apparatus as recited in claim 4, wherein a generally vertically moving slide is coupled to said air cylinder providing the assembly apparatus with motion in the Z-direction.

6. The automatic assembly apparatus as recited in claim 1 wherein said counterbalance means is a spring under compressive force that counteracts the weight of the assembly apparatus, and wherein the differential effect of the compressive force and the weight selectively provides the assembly apparatus with an upward and downward movement.

7. The automatic assembly apparatus as recited in claim 1, wherein said manual positioning means includes a handle attached to said grip such that an operator may grip said handle and position said bit on said work piece.

8. The automatic assembly apparatus as recited in claim 7, wherein said handle attached to said fastener driver, extends in a generally horizontal direction.

9. The automatic assembly apparatus as recited in claim 1, wherein said gripper means further comprises:

a band clutch;

a switch coupled to said band clutch; and pivotal air jaw for selectively tightening said band clutch such that the tightening action of said band clutch depresses said switch, thereby inhibiting the assembly apparatus from rotating.

10. The automatic assembly apparatus as recited in claim 9, wherein said air jaw further comprises two arms that pivotally close on each other, selectively tightening said band clutch.

11. The automatic assembly apparatus as recited in claim 1, wherein said mounting means further comprises a first and a second section pivotally attached to each other, wherein an end of the said first section is pivotally attached to said point of reference and an end of said second section is pivotally attached to said driver.

12. The automatic assembly apparatus as recited in claim 1, further comprising switching means for selectively locking in position and activating the apparatus.

13. The automatic assembly apparatus as recited in claim 4, wherein said air cylinder selectively overcomes the action of said counterbalance means moving the apparatus downward.

14. An automatic assembly apparatus comprising:

a torque arm pivotally anchored at one end to a rigid surface;

an automatic fastener driver coupled to a second end of said torque arm and supported by said torque arm, said automatic fastener driver including a pneumatic bit driver;

a handle attached to said automatic fastener driver;

an air cylinder coupled to said automatic fastener driver;

a spring offsetting the weight of the assembly apparatus; and at least one gripper for selectively preventing said fastener driver from rotating, wherein by selectively activating said air cylinder, the assembly apparatus is locked in position at the work piece and drives a fastener into said work piece, independent of any manual intervention.

* * * * *